US010644392B2

(12) United States Patent
Matute

(10) Patent No.: US 10,644,392 B2
(45) **Date of Patent: *May 5, 2020**

(54) LIGHTING DEVICE COVER WITH BUILT-IN ANTENNA

(71) Applicant: Eaton Intelligent Power Limited, Dublin (IE)

(72) Inventor: Leonardo Enrique Matute, Atlanta, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/513,479

(22) Filed: Jul. 16, 2019

(65) Prior Publication Data

US 2019/0341685 A1 Nov. 7, 2019

Related U.S. Application Data

(63) Continuation of application No. 15/628,459, filed on Jun. 20, 2017, now Pat. No. 10,374,303.

(60) Provisional application No. 62/352,253, filed on Jun. 20, 2016.

(51) Int. Cl.
*H01Q 1/44* (2006.01)
*H01Q 1/22* (2006.01)

(52) U.S. Cl.
CPC ..... *H01Q 1/44* (2013.01); *H01Q 1/22* (2013.01)

(58) Field of Classification Search
CPC ..... H01Q 1/44; H01Q 1/22
See application file for complete search history.

(56) References Cited

U.S. PATENT DOCUMENTS

| | | | |
|---|---|---|---|
| 9,607,260 | B2 | 3/2017 | Yosui et al. |
| 9,716,316 | B2 | 7/2017 | Park et al. |
| 2017/0365919 | A1 | 12/2017 | Hovmoller |

*Primary Examiner* — Graham P Smith
(74) *Attorney, Agent, or Firm* — King & Spalding LLP

(57) ABSTRACT

A cover of a lighting device includes a front surface and a back surface, where the back surface is on an opposite side of the front surface. The cover further includes an antenna formed in the back surface, where the antenna is exposed on the back surface of the cover.

20 Claims, 8 Drawing Sheets

LIGHTING DEVICE COVER WITH BUILT-IN ANTENNA

CROSS REFERENCE TO RELATED APPLICATIONS

The present application is a continuation of and claims priority under to U.S. Nonprovisional patent application Ser. No. 15/628,459, filed Jun. 20, 2017 and titled "Lighting Device Cover With Built-In Antenna," which claims priority under 35 U.S.C. Section 119(e) to U.S. Provisional Patent Application No. 62/352,253, filed Jun. 20, 2016 and titled "Lighting Device Faceplate With Built-In Antenna," the entire contents of both of which are incorporated herein by reference.

TECHNICAL FIELD

The present disclosure relates generally to lighting solutions, and more particularly to antennas built into a plastic covers of lighting devices.

BACKGROUND

Lighting devices with wireless communication capability use antennas for transmission and reception of wireless signals. For example, switches, dimmers, wallstations, power outlets, lighting fixtures, etc. may communicate wirelessly with other devices such as lighting control devices, lighting fixtures as well as network gateway devices. The antennas of lighting devices, such as switches, are often built as a unit with other components of the lighting devices that are generally positioned within metal enclosures. Because of the shielding effect of metal, the metal enclosures may reduce the effectiveness of the antenna in receiving and transmitting wireless signals. Thus, a solution that reduces the effect of the metal housings on antennas of lighting devices is desirable.

SUMMARY

The present disclosure relates generally to lighting solutions, and more particularly to antennas built into plastic covers of lighting devices. In an example embodiment, a faceplate of a lighting device includes a base plate having a front surface and a back surface. The back surface is on an opposite side of the front surface. The faceplate further includes an antenna formed in the back surface of the faceplate. The antenna is exposed on the back surface of the faceplate.

In another example embodiment, a faceplate of a lighting device includes a base plate having a front surface, a back surface, and an opening through the base plate. The back surface is on an opposite side of the front surface. The faceplate further includes a first antenna formed in the back surface. The first antenna is exposed on the back surface of the faceplate. The faceplate also includes a second antenna formed in the back surface. The second antenna is exposed on the back surface of the faceplate.

In another example embodiment, a lighting device includes a wireless transceiver and a faceplate. The faceplate includes a base plate having a front surface and a back surface. The back surface is on an opposite side of the front surface. The faceplate further includes an antenna formed in the back surface. The antenna is exposed on the back surface of the faceplate, and the antenna is electrically coupled to the wireless transceiver.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
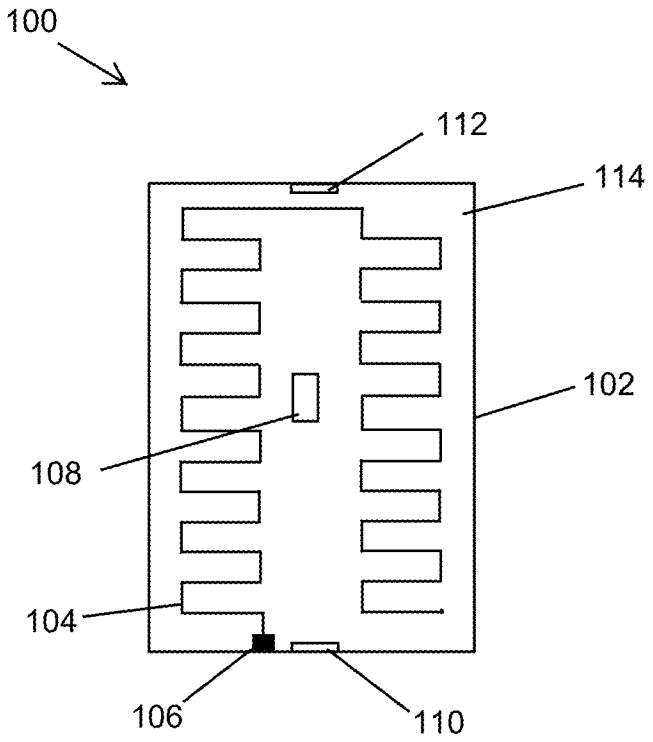
FIG. 1 illustrates a faceplate of a lighting device with a built-in antenna according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

In some example embodiments, a faceplate of a lighting device such as a switch, a dimmer, a wallstation, power outlet, etc. may be made from plastic. One or more antennas can be formed in the faceplate by methods such as printing a conductive material in the faceplate. An antenna that is built in the faceplate of a lighting device may provide improved antenna efficiency and a broader radiation pattern than an antenna that is positioned within a metal enclosure behind the faceplate. An antenna that is built in the faceplate of a lighting device may also provide improved antenna efficiency and broader radiation pattern than an antenna that is positioned close to wiring and other wall materials behind the lighting device. In some example embodiments, a faceplate may be an end cap, a side panel, or another part of the lighting fixture, in which one or more antennas can be located. In some example embodiments, the faceplate may include multiple antennas. For example, multiple antennas that are built in a faceplate may receive a wirelessly transmitted signal, where the received versions of the transmitted signal can be used for determining/estimating a direction and/or location of the transmitter that transmitted the wireless signal. For example, a circuit component (e.g., a microcontroller) may perform analysis, such as triangulation analysis, to determine/estimate the direction and/or location of the transmitter, for example, with respect to the faceplate.

Turning now to the figures, particular example embodiments are described. FIG. 1 illustrates a faceplate 100 of a lighting device with built-in antenna 104 according to an example embodiment. For example, the faceplate 100 may be a light switch faceplate. In some example embodiments, the faceplate 100 includes a base plate 102 and an antenna 104 that is built in the base plate 102. For example, the base plate 102 may be made from plastic, and the antenna 104 may be made from copper, aluminum, or another suitable metal.

The base plate 102 has a back surface 114 and a front surface that is on the opposite side of the back surface 114. The back surface 114 generally faces toward a wall and is hidden from view when the faceplate 100 or a lighting device that includes the faceplate 100 is mounted on a wall. The front surface of the base plate 102 is intended to be viewed by people when the faceplate 100 or a lighting device that includes the faceplate 100 is mounted on a wall or another similar structure such as a pillar. In embodiments where the lighting device 300 is a lighting fixture, the back surface 114 generally faces toward the inside of the lighting fixture and is hidden from view.

In some example embodiments, the antenna 104 is exposed on the back surface 114 of the base plate 102 and may be hidden from view when the faceplate 100 is mounted on a wall or a similar structure. For example, an entire portion or less than an entire portion of the antenna 104 may be exposed on the back surface 114 of the base plate 102. To illustrate, having the antenna 104 exposed on the back surface 114 may allow efficient transmission and reception of wireless signals by a lighting device that has a transceiver in electrical communication with the antenna 104. In some example embodiments, having the antenna 104 on the back surface 114 of the base plate 102 so that it is hidden from view by people allows the faceplate 100 to serve as an aesthetics piece. In some example embodiments, at least a portion of the antenna 104 may be intentionally exposed on the front surface of the base plate 102 for aesthetics reasons. For example, the base plate 102 may be made from a clear plastic material.

In some example embodiments, the faceplate 100 includes a pad 106 that is connected to the antenna 104 and that serves as an electrical contact for the antenna 104. For example, the pad 106 may be sized for ease of making electrical connection between the pad 106 and, for example, a pin or another contact of a radio circuit. For example, the radio circuit may be a transceiver of a lighting device that allows the lighting device to wirelessly communicate with other lighting devices. The pad 106 may be made from the same material as the antenna 104 or from another electrically conductive material. The pad 106 may be flush with the antenna 104 and/or the back surface 114. For example, the pad 106 may be made in the same manner as the antenna 104. Alternatively, the pad 106 may protrude out from the back surface 114. For example, the pad may be made in the same manner as the antenna 104 or may be attached after the antenna 104 is built in the base plate 102.

In some example embodiments, the base plate 102 may include an opening 108. For example, a shaft of a light switch may extend through the opening 108 when the light switch that has the faceplate 100 is installed on a wall or a similar structure. In some alternative embodiments, the opening 108 may have other shapes than shown without departing from the scope of this disclosure. In some alternative embodiments, the base plate 102 may include multiple openings without departing from the scope of this disclosure. For example, the faceplate 100 may be a power outlet cover. In yet other alternative embodiments, the opening 108 may be omitted. For example, the faceplate 100 may be an end cap of a lighting fixture.

In some example embodiments, the faceplate 100 may include clips 110, 112 or a similar structure for attaching the faceplate 100 to an enclosure or another structure of a lighting device. Alternatively, the clips 110, 112 or a similar structure may be used to attach the faceplate 100 to a wall structure or a similar structure without departing from the scope of this disclosure.

In some example embodiments, a method including a laser direct structuring (LDS) process may be used to make the faceplate 100 with the built-in antenna 104. For example, a conductive material may be printed in the base plate 102 to make the faceplate 100. The faceplate 100 may also be made using other methods as may be contemplated by those of ordinary skill in the art with the benefit of this disclosure.

In some applications, wireless communication capable lighting devices, such as switches, that use the faceplate 100 with the built-in antenna 104 may be able to more reliably communicate wirelessly with a network gateway and other lighting devices as compared to wireless communication capable lighting devices with antennas positioned within a metal enclosure of the lighting devices or close to other wires and wire traces.

In general, the faceplate 100 may be a light switch, a dimmer, a wallstation, a power outlet, an end cap of a lighting fixture, a side panel of a lighting fixture, a trim of a lighting fixture, etc. In some example embodiments, the base plate 102 may be made from a material other than plastic or in addition to plastic without departing from the scope of this disclosure.

Although the pad 106 is shown in FIG. 1 as having a particular shape, in alternative embodiments, the pad 106 may have other shapes and may include multiple segments. In some alternative embodiments, the pad 106 may be located at a different position than shown without departing from the scope of this disclosure. In some alternative embodiments, the antenna 104 may have a different length, shape, thickness and may be routed differently than shown in FIG. 1 without departing from the scope of this disclosure. In some alternative embodiments, the faceplate 1000 may include one or more additional antennas that are separate from the antenna 104 without departing from the scope of this disclosure.

Figure 2:
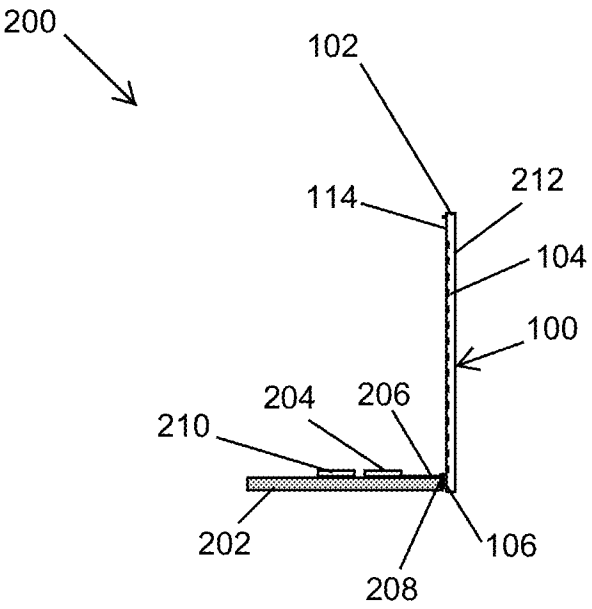
FIG. 2 illustrates a lighting device with a built-in antenna faceplate according to an example embodiment.

FIG. 2 illustrates a lighting device 200 with a built-in antenna faceplate 100 according to an example embodiment. Referring to FIGS. 1 and 2, the lighting device 200 includes the faceplate 100 and a radio component 204 (e.g., transceiver and/or amplifier) disposed on a printed circuit board 202. A wire trace 206 may extend from the radio component 204 to an edge of the printed circuit board 202 and may be terminated at a contact 208. For example, the contact 208 may be a pad or a pin (e.g., flexible pin) that is in contact with the pad 106 of the faceplate 100. In some example embodiments, one or more other electrical component 210 may also be disposed on the printed circuit board 202.

When the lighting device 200 is installed, for example, on a wall, a front face 212 of the faceplate 100 faces away from the wall and is generally viewable by occupants. The back surface 114 is generally hidden from view and faces toward the wall. The antenna 104 may be exposed, fully or partially, on the back surface 114 and is generally hidden from view from the front surface 212.

By establishing an electrical connection between the radio component 204 and the antenna 104 through the wire trace 206, the contact 208, and the pad 106, the radio component 204 may transmit and receive wireless signals via the antenna 104. In some alternative embodiments, a pin of the radio component 204 may be in contact with the pad 106 without the use of the trace and the contact 208. In yet other alternative embodiments, the radio component 204 may be electrically coupled to the pad 106 using the trace 206 and without use of the contact 208. For example, an electrical wire may be coupled to the pad 106 and the trace 206. An electrical wire may be coupled to a pin of the radio component 204 and the pad 106 or the antenna 104. For example, in some example embodiments, the pad 106 may be omitted.

In some alternative embodiments, the faceplate 100 may include one or more additional antennas that are separate from the antenna 104 without departing from the scope of this disclosure. For example, the radio component 204 or the electrical component 210 (e.g., a microcontroller) may perform analysis (e.g., triangulation analysis) based on the signal received by each antenna of the multiple antennas to determine/estimate the direction and/or location of a transmitter that transmits a wireless signal received by the multiple antennas, for example, with respect to the faceplate.

Although the lighting device 200 is described as including the printed circuit board 202, in some alternative embodiments, the printed circuit board 202 may be omitted, and the lighting device 200 may include a radio circuit or component that is not attached to a printed circuit board without departing from the scope of this disclosure.

Figure 3:
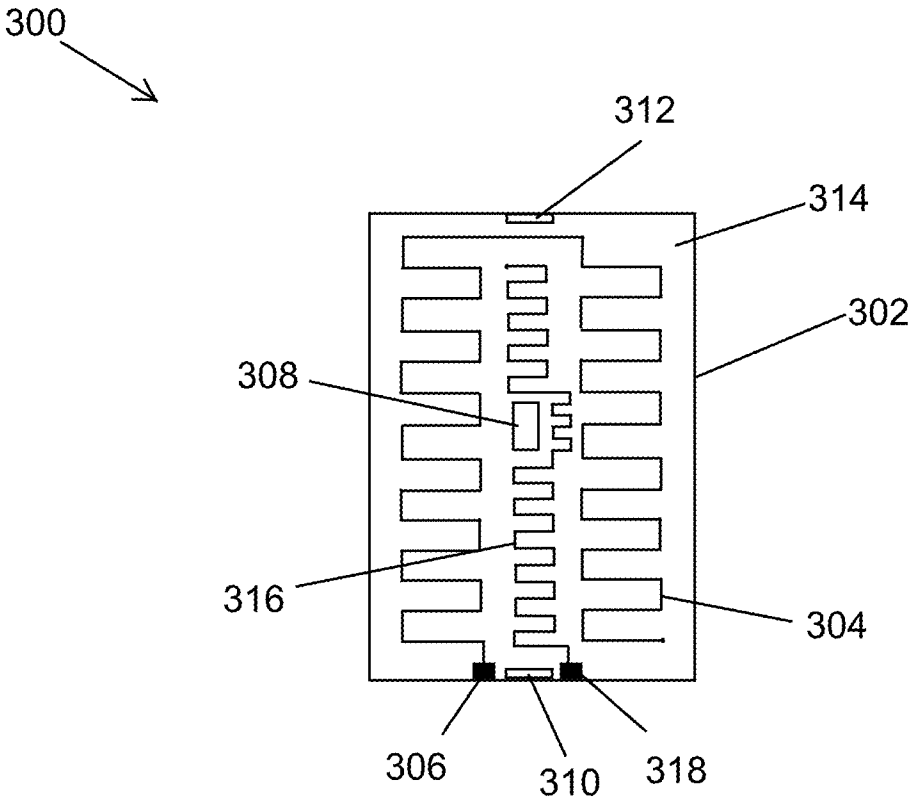
FIG. 3 illustrates a faceplate of a lighting device with multiple built-in antennas according to an example embodiment.

FIG. 3 illustrates a faceplate 300 of a lighting device with two built-in antennas according to an example embodiment. The faceplate 300 includes a base plate 302, a first antenna 304, and a second antenna 316. The faceplate 300 may be made from the same materials and using the same method described with respect to the faceplate 100 of FIG. 1. To illustrate, the base plate 302 may be made from plastic and the antennas 304, 316 may be made from a metal such as copper, using, for example, a laser direct structuring (LDS) process. For example, a conductive material may be printed in the base plate 302 to form the faceplate 300.

The base plate 302 has a back surface 314 and a front surface that is on the opposite side of the back surface 314. The back surface 314 generally faces toward a wall or the inside of a lighting fixture and is hidden from view when the faceplate 100 or a lighting device that includes the faceplate 300 is mounted on a wall. The front surface of the base plate 302 is intended to be viewed by people when the faceplate 300 or a lighting device that includes the faceplate 300 is mounted on a wall or another similar structure such as a pillar. In embodiments where the lighting device 300 is a lighting fixture, the back surface 314 generally faces toward the inside of the lighting fixture and is hidden from view.

In some example embodiments, the faceplate 300 includes a first pad 306 coupled to the antenna 304 and a second pad 318 coupled to the antenna 316. For example, the pad 306 may serve as an electrical contact for electrically coupling the antenna 304 with a pad, a pin, a trace, etc. of or coupled to a radio component/circuit. The pad 318 may serve as an electrical contact for electrically coupling the antenna 316 with a pad, a pin, a trace, etc. of or coupled to a radio component/circuit. To illustrate, a radio component/circuit may transmit and receive wireless signals through the antenna 304 when the antenna 304 is electrically coupled to the radio component/circuit via the pad 306. The same radio component/circuit or a different radio component/circuit may also transmit and receive wireless signals via the antenna 316 when the antenna 316 is electrically coupled to the radio component/circuit via the pad 318.

In some example embodiments, the antenna 304 may be used to transmit and receive wireless signals that are compliant with a first standard (e.g., Wi-Fi) and the antenna 316 may be used to transmit and receive wireless signals that are compliant with a second standard (e.g., ZigBee or Bluetooth) that is different from the first standard. The antenna 304 may also be used to transmit and receive wireless signals that have a lower frequency than wireless signals transmitted and received via the antenna 316.

In some example embodiments, the antenna 304 and the antenna 316 may be used to transmit and receive wireless signals that are compliant with a particular communication standard. For example, a radio component or an electrical component (e.g., a microcontroller) may perform analysis (e.g., triangulation analysis) based on the signal received by each antenna of antenna 304, 316 to determine/estimate the direction and/or location of a transmitter that transmits the wireless signal received by the antennas 304, 316. For example, the radio component 204 of FIG. 2, the electrical component 210 of FIG. 2, or another electrical component may perform the analysis to determine/estimate the direction/location of the transmitter.

In some example embodiments, the faceplate 300 may include clips 310, 312 or a similar structure for attaching the faceplate 300 to an enclosure or another structure of a lighting device. Alternatively, the clips 310, 312 or a similar structure may be used to attach the faceplate 300 to a wall structure, a lighting fixture housing, or a similar structure without departing from the scope of this disclosure.

In some example embodiments, the base plate 302 includes an opening 308 that may be used in a similar manner as the opening 108 of the faceplate 100 of FIG. 1. In some alternative embodiments, the opening 308 may have a different size and shape than shown in FIG. 3 without departing from the scope of this disclosure. In some example embodiments, the opening 308 may be omitted without departing from the scope of this disclosure. For example, the faceplate 300 may be an end cap or a side panel of a lighting fixture.

In general, the faceplate 300 may be a light switch, a dimmer, a wallstation, a power outlet, an end cap of a lighting fixture, a side panel of a lighting fixture, etc. In some example embodiments, the base plate 302 may be made from a material other than plastic or in addition to plastic without departing from the scope of this disclosure.

In some alternative embodiments, the pads 306, 318 may be omitted or may be coupled to a respective electrical wire. In some alternative embodiments, the faceplate 300 may include a pin coupled to the pad 306 to provide an electrical contact between the antenna 304 and a radio component/circuit. The faceplate 300 may also include another pin coupled to the pad 318 to provide an electrical contact between the antenna 316 and a radio component/circuit. In some alternative embodiments, a first electrical wire may be connected to the pad 306, and a second electrical wire may be connected to the pad 318, where electrical wires are coupled to one or more radio components/circuits distal from the faceplate 300. In some alternative embodiments, the antennas 304, 316 may have a different size, shape, relative positions, and may be routed differently than shown in FIG. 3 without departing from the scope of this disclosure. For example, the antennas 304, 316 may be routed to allow a different opening or multiple openings in the base plate 302. In some example alternative embodiments, the faceplate 300 may include more than two antennas without departing from the scope of this disclosure.

Figure 4:
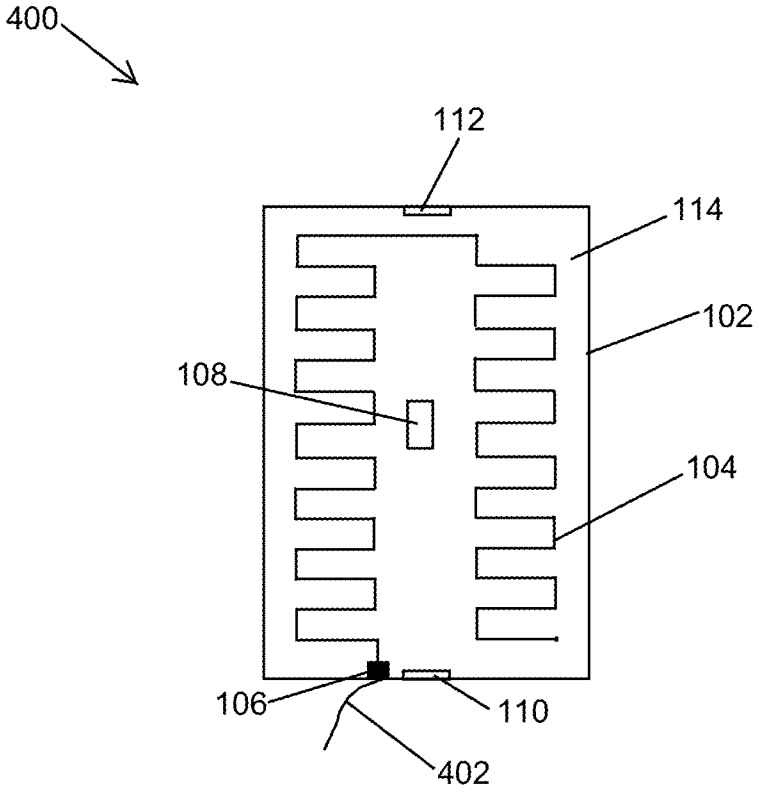
FIG. 4 illustrates a faceplate of a lighting device with a built-in antenna according to another example embodiment.

FIG. 4 illustrates a faceplate 400 of a lighting device with the built-in antenna 104 according to another example embodiment. In some example embodiments, the faceplate 400 is substantially the same as the faceplate 100 of FIG. 1 with the addition of an electrical wire 402. Referring to FIGS. 1, 2, and 4, the electrical wire 402 may be attached to the pad 106 to provide an alternative attachment of the antenna 104 to a radio circuit of a lighting device. For example, as described with respect to FIG. 2, the radio circuit may be a transceiver of a lighting device that allows the lighting device to wirelessly communicate with a network gateway device, a lighting control device, or other lighting devices. To illustrate, in some example embodiments, electrical coupling of the antenna to a radio circuit of a lighting device may be easier to implement using the wire 402 than a pad-to-pad, a pad-to-pin, or other similar connections means. The wire 402 may be soldered to the antenna 104 or may be attached by other means as may be contemplated by those of ordinary skill in the art with the benefit of this disclosure.

In some alternative embodiments, the pad 106 may be omitted, and the wire 402 may be coupled to the antenna 104. For example, the wire 402 may be soldered to the antenna 104. Alternatively, the wire 402 may be attached to the antenna 104 by other means as may be contemplated by those of ordinary skill in the art with the benefit of this disclosure.

Figure 5:
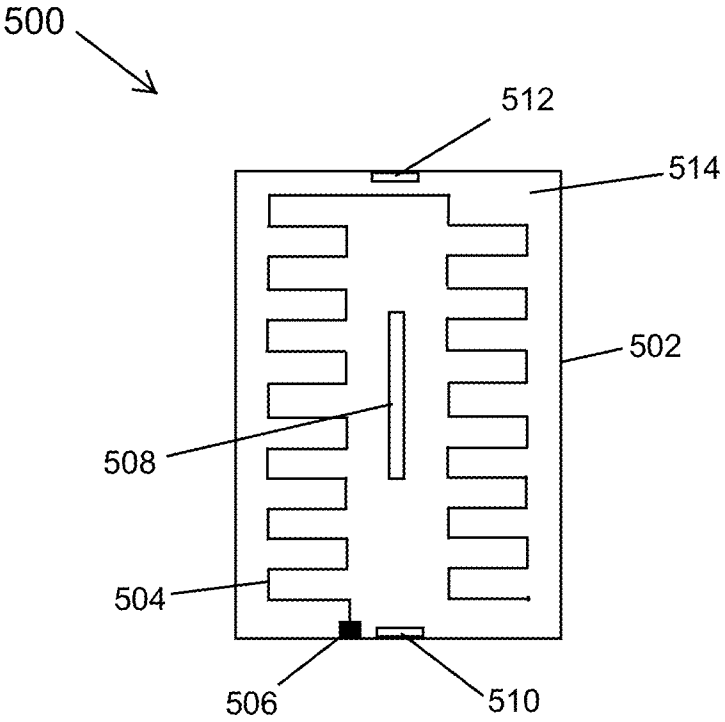
FIG. 5 illustrates a faceplate of a lighting device with a built-in antenna according to another example embodiment.

FIG. 5 illustrates a faceplate 500 of a lighting device with built-in antenna 504 according to another example embodiment. For example, the faceplate 500 may be a dimmer faceplate. The faceplate 500 is similar to and may be made and used in substantially the same manner as the faceplate 100 of FIG. 1. To illustrate, the faceplate 500 includes a base plate 502 and an antenna 504 that is built into the base plate 502. For example, the base plate 502 may be made from plastic, and the antenna 504 may be made from copper, aluminum, or another suitable metal. The base plate 502 has a back surface 514 and a front surface that is on the opposite side of the back surface 514. The back surface 514 generally faces toward a wall and is hidden from view when the faceplate 500 or a lighting device that includes the faceplate 500 is mounted on a wall. The front surface of the base plate 502 is intended to be viewed by people when the faceplate 500 or a lighting device that includes the faceplate 500 is mounted on a wall or another similar structure such as a pillar.

In some example embodiments, the faceplate 500 includes a pad 506 that is connected to the antenna 504 and that serves as an electrical contact for the antenna 504. The pad 506 may be the same as the pad 106 shown in FIG. 1. The base plate 502 may also include an opening 508 that allows a dim adjustment shaft to be extended therethrough. The faceplate 500 may also include clips 510, 512 or a similar structure for attaching the faceplate 500 to an enclosure or another structure of a lighting device or to a wall or similar structure.

Although the pad 506 is shown in FIG. 5 as having a particular shape, in alternative embodiments, the pad 506 may have other shapes and may include multiple segments. In some alternative embodiments, the pad 506 may be located at a different position than shown without departing from the scope of this disclosure. In some alternative embodiments, the antenna 504 may have a different length, shape, thickness and may be routed differently than shown in FIG. 5 without departing from the scope of this disclosure.

Figures 6A, 6B, 6C:
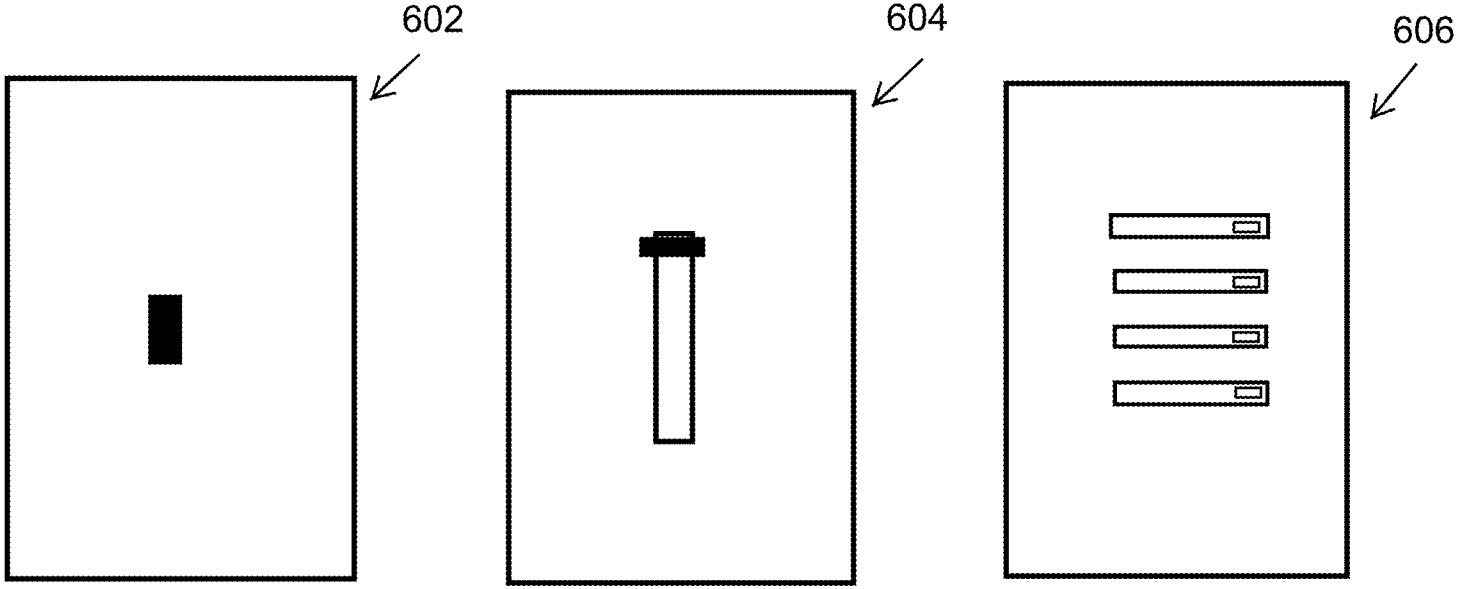
FIGS. 6A-6C illustrate lighting devices with a built-in antenna faceplate according to example embodiments.

FIGS. 6A-6C illustrate lighting devices with a built-in antenna faceplate according to example embodiments. FIG. 6A illustrates a faceplate 602 of a light switch according to an example embodiment. For example, the faceplate 602 may include a front face 608 that is opposite a back surface that includes one or more antennas. FIG. 6B illustrates a faceplate 604 of a dimmer according to an example embodiment. For example, the faceplate 604 may include a front face 610 that is opposite a back surface that includes one or more antennas. FIG. 6C illustrates a faceplate 606 of a wallstation according to an example embodiment. For example, the faceplate 606 may include a front face 612 that is opposite a back surface that includes one or more antennas. In some example embodiments, each faceplate 602, 604, 606 may be made in a similar manner as described above.

Figure 7:
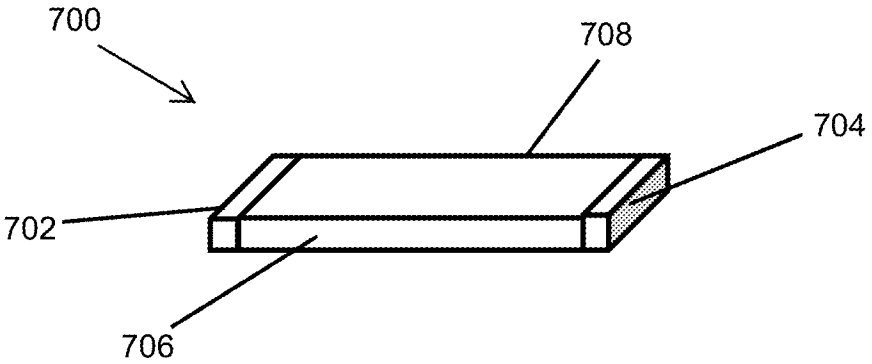
FIG. 7 illustrates a lighting fixture having end caps with one or more built-in antennas according to an example embodiment.

FIG. 7 illustrates a lighting fixture 700 having end caps 702, 704 with one or more built-in antennas according to an example embodiment. In some example embodiments, the end caps 702, 704 may each correspond to the faceplate 100, 300, or 400. The antenna in each end cap 702, 704 may face inward and is hidden from view. For example, the back surface of each end cap 702, 704 may include an antenna such as the antenna 104 of FIG. 1. As another example, the back surface of each end cap 702, 704 may include two antennas such as the antennas 304, 316 of FIG. 3. In some example embodiments, one or both side panels 706, 708 may also include one or more antennas.

In some example embodiments, the wireless signal received by each antenna of the lighting fixture 700 may be provided to an electrical component, for example, to determine/estimate (e.g., by triangulation) the direction and/or location of a transmitter that transmits the wireless signal received by the multiple antennas.

In some example embodiments, some of the antennas built in one or more of the end caps and side panels may receive signals that are compliant with a different communication standard than signals received by the remaining antennas of the lighting fixture 700 built in the end caps and side panels. In some alternative embodiments, the lighting fixture 700 may be a different type of lighting fixture than shown in FIG. 7 without departing from the scope of this disclosure.

Figure 8:
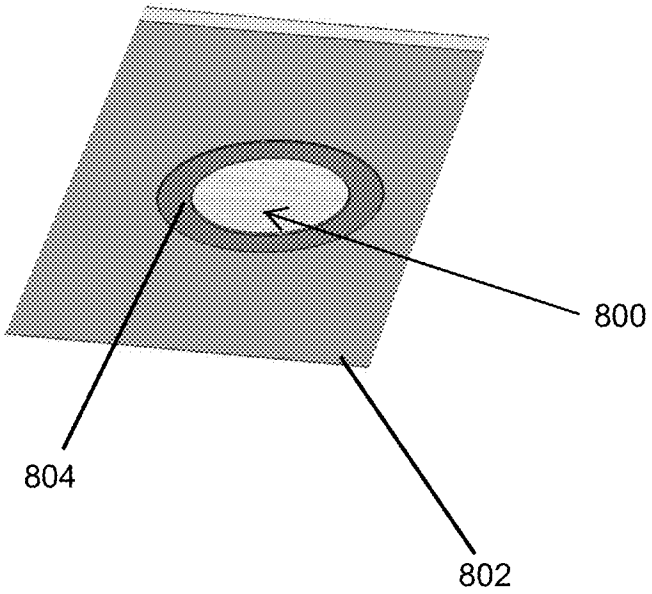
FIG. 8 illustrates a lighting fixture having a trim with one or more built-in antennas according to an example embodiment.

FIG. 8 illustrates a lighting fixture 800 having a trim 804 with one or more built-in antennas according to an example embodiment. In some example embodiments, the lighting fixture 800 may be recessed in a ceiling 802. One or more antennas may be formed in the trim 804 in the same manner as described above with respect to faceplates 100, 300. When multiple antennas are built in the trim 804, direction and/or location of a transmitter may be determined by an electrical component (e.g., a microcontroller) in the same manner as described above.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A cover of a lighting device, the cover comprising:

a front surface and a back surface, wherein the back surface is on an opposite side of the front surface; and an antenna formed in the back surface, wherein the antenna is exposed on the back surface of the cover.

2. The cover of claim 1, further comprising a contact pad coupled to the antenna, wherein the contact pad is positioned to make an electrical contact with a pad or a pin extending from a printed circuit board.

3. The cover of claim 1, further comprising an electrical wire coupled to and extending from the antenna.

4. The cover of claim 1, wherein the cover is made from plastic.

5. The cover of claim 4, wherein the antenna is made from copper.

6. The cover of claim 1, wherein an opening is formed in the cover.

7. The cover of claim 6, wherein the lighting device is a dimmer or a light switch.

8. The cover of claim 6, wherein the lighting device is a power outlet.

9. The cover of claim 1, wherein the cover is an end cap or a trim of a lighting fixture.

10. A cover of a lighting device, the cover comprising:

a front surface, a back surface, and an opening through the cover, wherein the back surface is on an opposite side of the front surface;

a first antenna formed in the back surface, wherein the first antenna is exposed on the back surface of the cover; and a second antenna formed in the back surface, wherein the second antenna is exposed on the back surface of the cover.

11. The cover of claim 10, further comprising a first contact pad coupled to the first antenna, a second contact pad coupled to the second antenna, wherein each contact pad is positioned to make electrical contacts with a respective pad or pin extending from a printed circuit board.

12. The cover of claim 10, wherein the cover is an end cap or a trim of a lighting fixture and wherein the lighting device includes the lighting fixture.

13. The cover of claim 10, wherein the cover is made from plastic, and wherein the antenna is made from copper.

14. The cover of claim 10, wherein an opening is formed in the cover.

15. The cover of claim 14, wherein the cover is a portion of a dimmer, a light switch, or a power outlet.

16. A lighting device, comprising:

a wireless transceiver;

a cover plate having a front surface and a back surface, wherein the back surface is on an opposite side of the front surface; and an antenna formed in the back surface, wherein the antenna is exposed on the back surface of the cover plate and wherein the antenna is electrically coupled to the wireless transceiver.

17. The lighting device of claim 16, further comprising a second antenna formed in the back surface, wherein the second antenna is exposed on the back surface of the cover plate.

18. The lighting device of claim 17, further comprising an electrical component that analyzes an electrical signal from each of the first antenna and the second antenna to determine a direction or location of a transmitting device that transmits a wireless signal received by the first antenna and the second antenna.

19. The lighting device of claim 16, wherein the lighting device is a lighting switch, a dimmer, a power outlet, or a wallstation.

20. The lighting device of claim 16, wherein the lighting device is a lighting fixture and wherein the cover plate is an end cap or a trim.

* * * * *